United States Patent [19]

Warnshuis, Jr. et al.

[11] 4,298,964

[45] Nov. 3, 1981

[54] TOWED DEPLOYMENT OF ACOUSTIC ARRAYS

[75] Inventors: Paul L. Warnshuis, Jr., Rancho Santa Fe; Peter V. Serrell, Solana Beach, both of Calif.

[73] Assignee: The United States of America as represented by the Secretary of the Navy, Washington, D.C.

[21] Appl. No.: 142,322

[22] Filed: Apr. 21, 1980

[51] Int. Cl.[3] ..... H04R 1/44

[52] U.S. Cl. ..... 367/4; 367/153; 367/173

[58] Field of Search ..... 367/4, 131, 153, 165, 367/173

[56] References Cited

U.S. PATENT DOCUMENTS 3,160,847 12/1964 Beck et al. ..... 367/165

3,566,346 2/1971 Scopatz ..... 367/153

*Primary Examiner*—Richard A. Farley

*Attorney, Agent, or Firm*—Richard S. Sciascia; Ervin F. Johnston; Thomas Glenn Keough

[57] ABSTRACT

A compact, unitary sensor array support structure for use in a water medium comprises a plurality of scissor arms mounted on a support. The scissor arms are extended from the support to expand the sensor array, and are retracted to the support when the array is to be recovered. The support with the scissor arms retracted thereto is slidably housed within a container. Together, the support and the container form a hydrodynamic body which can be transported by towing in the water or removed from the water for transport or storage.

20 Claims, 6 Drawing Figures

TOWED DEPLOYMENT OF ACOUSTIC ARRAYS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention pertains to the field of oceanographic instrumentation systems. More particularly, this invention pertains to the field of support structure design for sonar systems. By way of further characterization, but without specific limitation thereto, this invention provides for a compact, highly portable instrumentation array support structure which can be quickly expanded for deployment and easily retracted for retrieval, storage, and transport.

The accurate and early detection of underwater acoustic events requires the use of large sonar arrays. The size of the array determines the maximum spatial separation of the individual transducers which, in turn, fixes the range and sensitivity of the sonar array.

In the past, support structures for long range sonar systems comprised discrete elements such as buoys and suspended platforms which were individually deployed. Such structures require long deployment and retrieval times, considerable support resources, and use of scarce shipboard space for transport.

Prior art shows the construction and use of unitary sonar array support structures which are expandable for operational use and retractable for retrieval, transport, and storage. Such structures employ a central support body to which are attached a number of elongated support arms which are pivoted at their ends outwardly from the body and extend radially therefrom during deployment, and are pivoted inwardly to lie against the body for retraction and retrieval of the structure.

The compactness of the prior art devices is limited by the length of the support arms. Since the arms, when retracted, lie against the support bodies, the bodies cannot be shorter than the arms. Since the lengths of the arms determine the radii of the arrays, there is a tradeoff of array size and support body length: large arrays entail non-compact structures; compact structures entail small, less sensitive arrays. In addition, the prior art devices must be lifted out of the water for transport and storage.

Maritime requirements for handleability and mobility demand sonar array structures which are as compact as possible for fast deployment and retrieval and for ease of transport and storage. At the same time, the need for compactness must not put a limit on the size of an expanded array lest range and sensitivity of the system be sacrificed.

SUMMARY OF THE INVENTION

This invention provides a support structure design which allows deployment of instrumentation arrays whose dimensions have minimal effect upon the compactness of the structure when retracted for transport. In addition, the design is of a structure which is easily transportable by towing in the water. These features are realized by employing a plurality of scissor arms which are mounted on a variably buoyant support, and which are extended radially therefrom for erection of a sonar array and retracted thereto for storage and transport.

The scissor arms are attached to the support by linkages which are coupled to a motor/gear assembly located in the bottom of the support. A variably buoyant container houses the support when the scissor arms are retracted. The support and container form a hydrodynamically shaped body. A cable connects the support to the container for suspension of the array beneath the container during deployment. A float is releasably housed within the container and connected to the container by a second cable to suspend the container beneath the float during deployment. A compact and efficient package results in which the combined length of the container and the support is significantly less than the length of the extended scissor arms. This enhances the handleability of the structure when it must be transported or stored. The hydrodynamic characteristics of the body comprising the support and container enable it to be transported by towing in the water while at sea, thus freeing onboard ship space required for transport of the retracted array.

STATEMENT OF THE OBJECTS OF INVENTION

It is an object of this invention to provide a compact support structure for a large sonar array.

Another object is to provide a large sonar array system which can be towed to a site in a retracted protected condition, lowered to a predetermined depth, expanded to a deployed condition with a link to the water surface for transmission of signals, and then retracted for towing to another site.

A further object of this invention is to provide an improved mechanism for the extension and retraction of large sonar arrays.

Yet another object of this invention is to provide an improved deployment apparatus useful in sonar systems.

A still further object of this invention is to provide an improved container for transport and storage of retracted sonar array structures.

A still further object of this invention is to provide an improved container for transport of retracted sonar structures at sea.

These and other objects of the invention will become readily apparent from the ensuing description when taken together with the drawings.

DESCRIPTION OF THE PREFERRED EMBODIMENT

Figure 1:
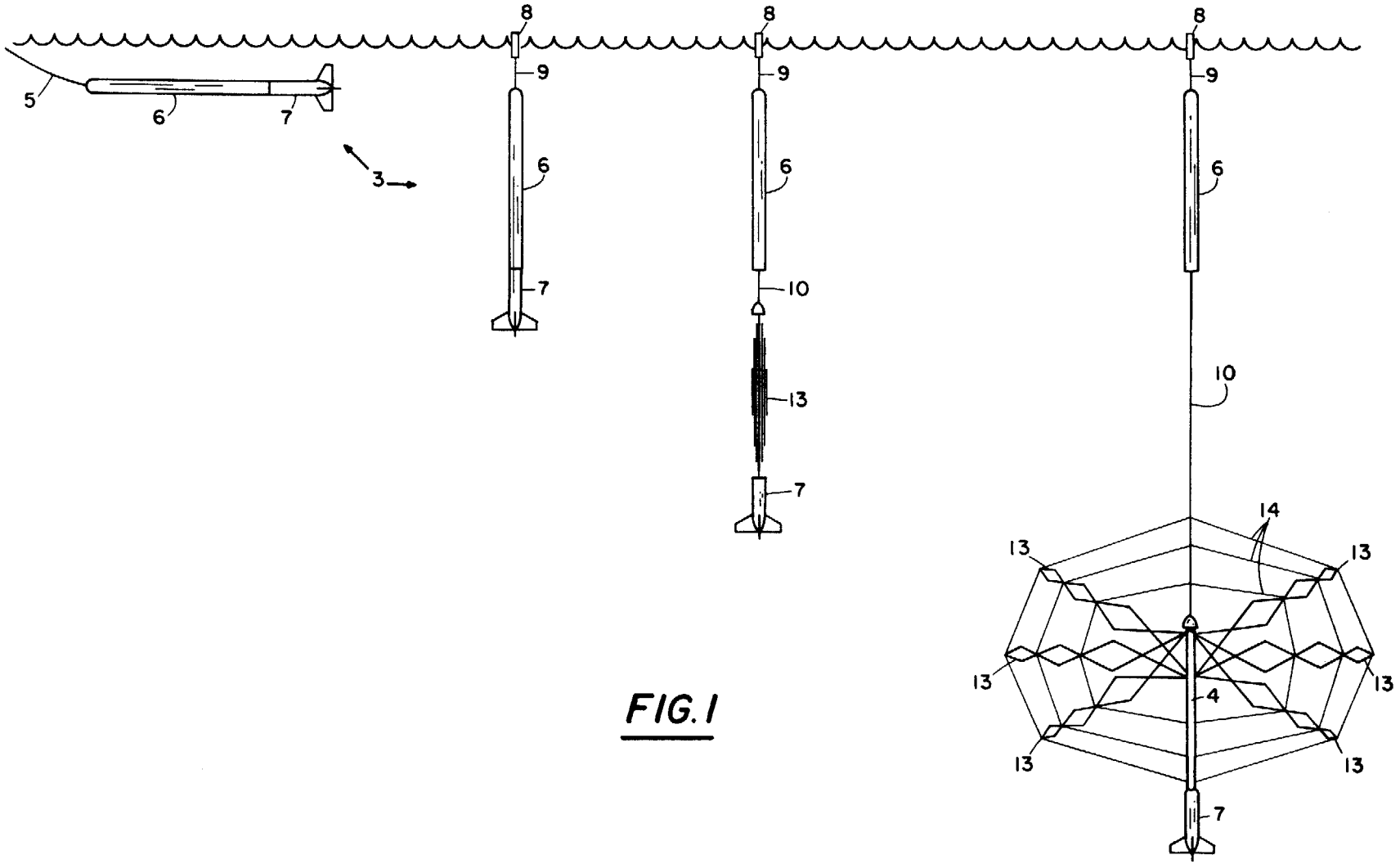
FIG. 1 is a perspective view of the invention showing it being towed, suspended, and erected.

Referring to FIG. 1, there is shown a deployment sequence of the preferred embodiment of the subject invention. A hydrodynamic body 3, comprising a forward container section 6 and an aft tail section 7, is towed below the surface of the water by a line 5 attached to the forward end of the container section 6. Upon reaching a deployment site, spar buoy 8 is released from the nose of container section 6, and the hydrodynamic body 3 is suspended vertically from spar buoy 8 on cable 9. A structure comprising tail section 7, elongated support structure 4, and folded scissor arms 13 is lowered out of container section 6 on cable 10. Scissor arms 13 are extended from support structure 4, thereby deploying an instrumentation array attached thereto in a spaced relationship. Tension ties 14 are provided between scissor arms 13 to maintain the scissor arms 13 radial to the longitudinal axis of support body 4 and evenly spaced.

Figure 2:
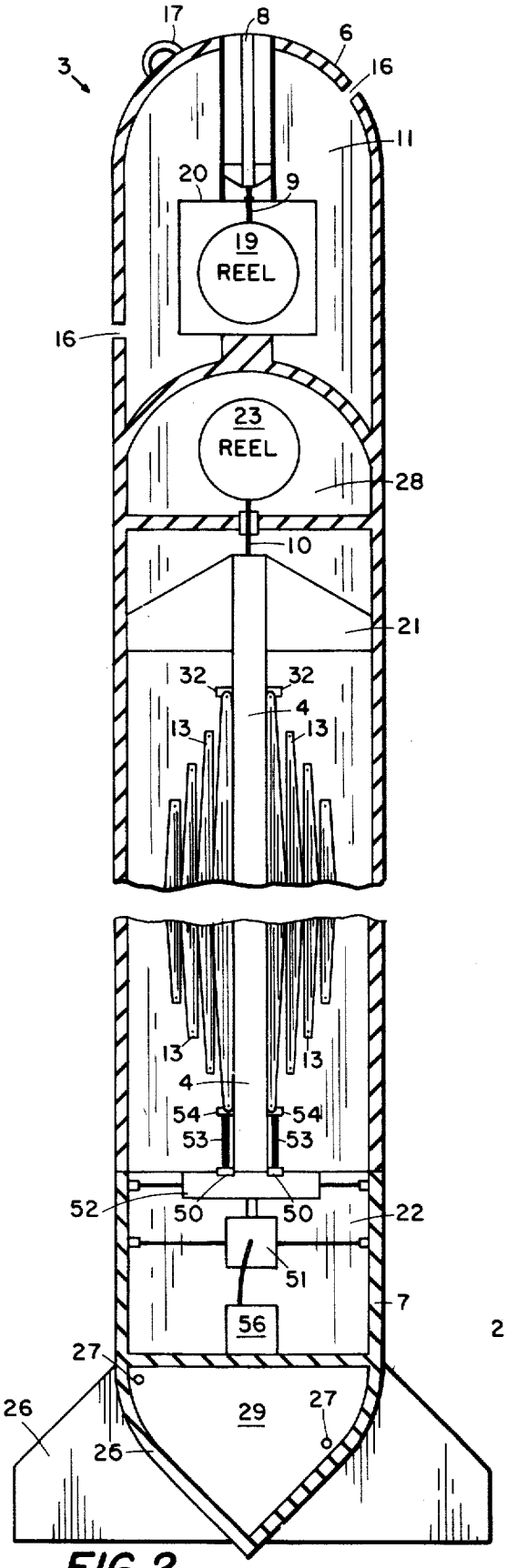
FIG. 2 is a compressed schematic of the invention in a retracted, stored configuration.

Referring to FIG. 2, a schematic of the apparatus illustrated in FIG. 1 is shown in a retracted configuration for transport and storage. Container section 6 contains a ballast chamber 11 to provide positive buoyancy during transport and negative buoyancy during deployment. Inlets 16 allow the admission or expulsion of seawater to change ballast. For this embodiment, a variety of ballast variance techniques are known in the art and can be utilized; choice among them is dependent upon parameters such as power, space, activation method, and desired buoyancy variation. A representative ballasting and deballasting apparatus is shown in U.S. Pat. No. 4,015,553, "Submersible Barge Control System", Frederick H. Middleton, Inventor.

Tow fastener 17 is mounted slightly above the centerline of container section 6. This allows hydrodynamic structure 3 to be towed at high speeds slightly below the sea surface which reduces drag and avoids large fluctuations in tow line tension.

Spar buoy 8, pocketed in the nose section of container section 6 is connected through a cable 9 to an appropriate reeling mechanism 19 permanently housed within the nose of container section 6. Cable 9 provides electrical and physical connection between spar buoy 8 and the deployed sensor array. Reeling mechanism 19, which can comprise a winch and a gear-or clutch-driven reversible electric motor, is placed within a watertight housing 20. Reeling mechanism 19 can be driven by an onboard source of electric power, or by an offboard source of electric power effectively connected through cable 9. Spar buoy 8 can be held in place when stowed in the nose of container section 6 by an appropriate latching mechanism, or by the mechanical resistance of reeling mechanism 19.

The lower part of container section 6 is seen to house a unitary structure comprising support body 4, scissor arms 13, and tail section 7. A plurality of fin-shaped flanges 21 extend radially from the top of support body 4 and provide guidance into the lower end of container section 6 when support body 4 is moved thereinto, and spacing when support body 4 is housed therein. Support body 4 is permanently attached to the top of tail section 7. Tail section 7 comprises an ogive section 25 and fins 26 extending radially outward therefrom to provide stabilization during towing. Ogive section 25 encloses ballast chamber 29 served by inlets 27 through which seawater ballast can be expelled or admitted. Scissor arm drive motor 51, gear box 52, and power source 56 are housed above ogive section 25 within watertight housing 22.

Support body 4 is attached at its upper end by cable 10 to reeling mechanism 23, essentially equivalent to reeling mechanism 19. Reeling mechanism 23 is housed within watertight housing 28. Cable 10 provides electrical and physical connection between container section 6 and support body 4. While housed within container section 6, support body 4 can be latched therein by an appropriate mechanism located on tail section 7, or by the mechanical resistance of reeling mechanism 20.

Upon deployment, spar buoy 8 is released from the nose section of container section 6 and allowed to float to the surface where it provides the suspending force for the deployed support structure. At the same time, ballast is admitted to ballast chambers 11 and 29 and reeling mechanism 19 is activated to unreel cable 9. In this manner, hydrodynamic body 3 assumes a vertical position beneath the surface of the water, and is suspended there by spar buoy 8. After suspension of hydrodynamic structure 3, reeling mechanism 23 is activated and support body 4, under the urging of the negatively buoyant tail section 7, slides out of container section 6 to be vertically suspended thereunder on cable 10. The assembly comprising support body 4, scissor arms 13, and tail section 7 is lowered to a desired depth where scissor arms 13 can be extended to expand the sensor array.

To retrieve the sensor array structure of the invention, scissor arms 13 are retracted, and reeling mechanism 23 is activated to draw support body 4 up to container section 6. Support body 4 with scissor arms 13 retracted thereto is guided into container section 6 by fin flanges 21. When support body 4 is in place within container section 6, reeling mechanism 19 is activated, ballast is expelled from ballast chamber 11, and hydrodynamic body 3 is reeled up to spar buoy 8. For transport, ballast is expelled from ballast chamber 29 and a tow line can be connected to hydrodynamic body 3 at tow fastener 17. Hydrodynamic body 3 can also be lifted out of the water for transport or storage.

It is obvious that a continuous electric channel extends from spar buoy 8 through cables 9 and 10 to support body 4. Separate electrical paths can be provided thereon for control, power, and data transfer. In the preferred embodiment, an auxiliary vessel, not shown, provides actuation control and power through spar buoy 8 for reeling mechanisms 19 and 23 and for the ballast variance equipment. Moreover, spar buoy 8 can also carry an electronic transmitter for transmission of telemetry data gathered from the instrumentation array mounted on scissor arms 13. Hence, the presence of an auxiliary vessel will be required only to deploy and retrieve the structure; during deployment, the structure can be powered by an on-board power source and be left to function without need of attendance.

Figure 3:
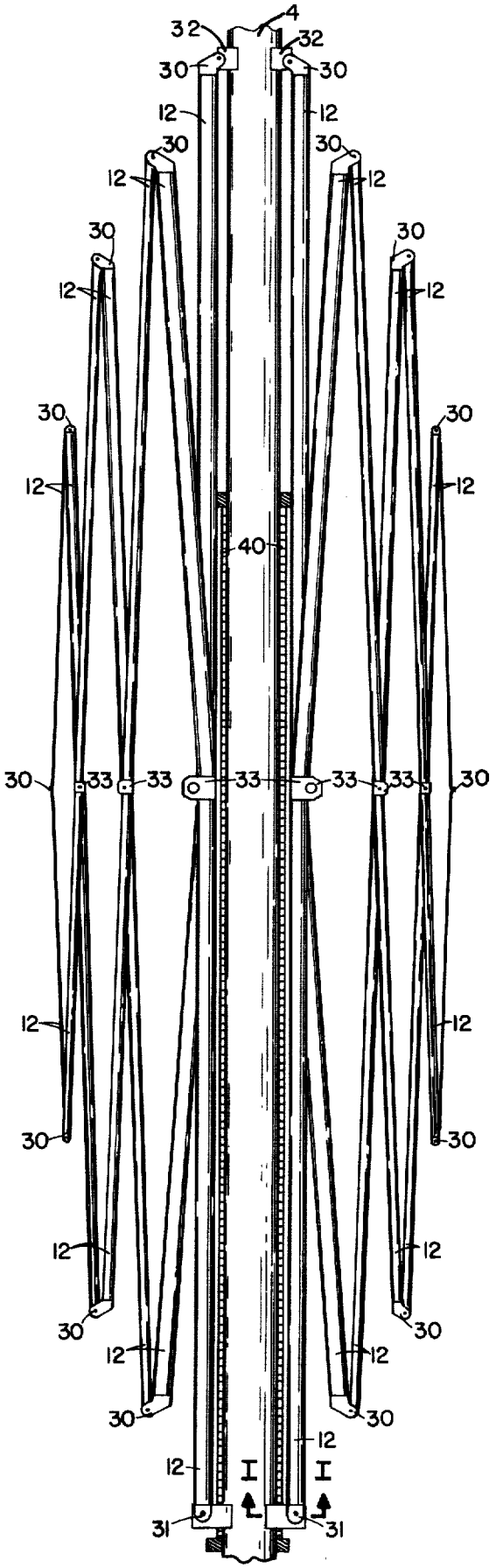
FIG. 3 is a plan view of a section of the support means of the invention with two scissor arms folded thereto.
Figure 4:
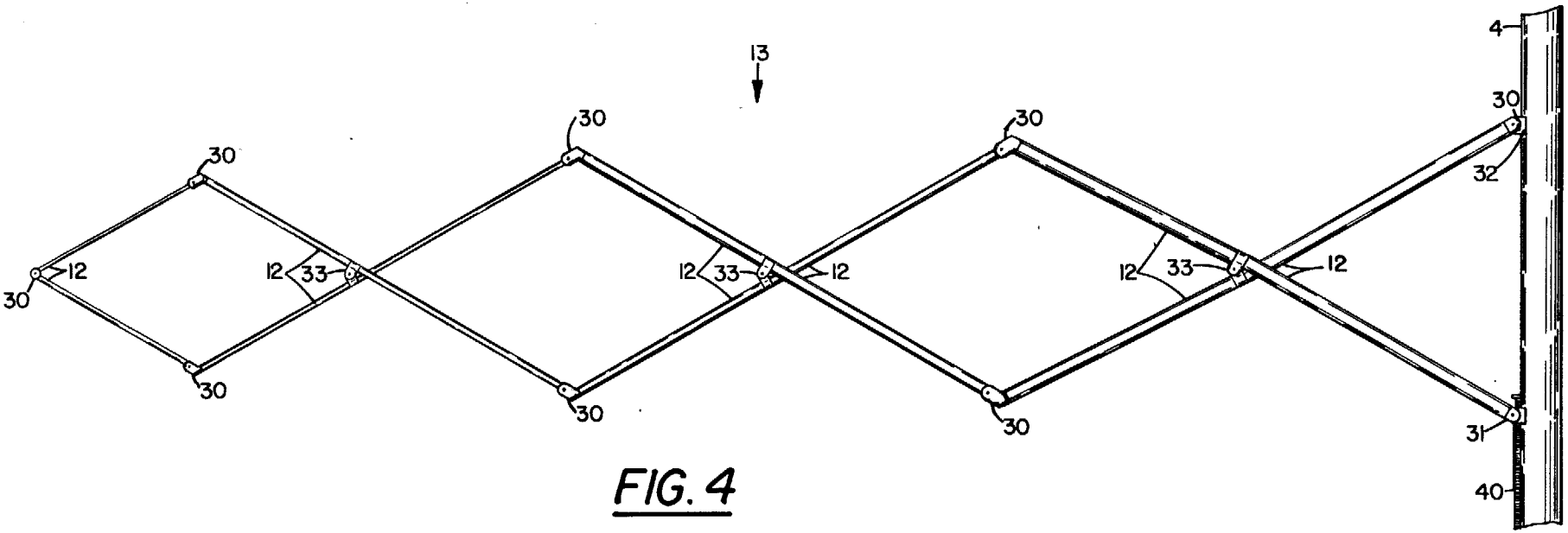
FIG. 4 is a plan view of one scissor arm fully extended.

In FIG. 3, a pair of scissor arms 13 are shown folded against a section of support body 4. In FIG. 4 one scissor arm 13 is shown in full extension from a section of support body 4. Each scissor arm 13 comprises, in the preferred embodiment, eight members 12, constructed from tubular extruded material, which are designed to be neutrally buoyant in seawater. The eight members 12 are hinged together to form an arm. To avoid welding at the highly stressed centers of the inner members, center hinges 33 are clamped to the members, and for added safety, bonded in place. End hinges 30 are welded in place, and also provide end closure for the members. Since the hinge pins for the center hinges 33 pass outside the member, and the pins for the end hinges 30 are tangent to the members on opposite sides, the inner members can be slightly bent at the center hinges 33 so that the three center hinge axes will lie in a straight line. Besides maintaining correct geometry, these offsets can also reduce the bending moments in the members.

The inner members 12 are attached to support body 4 by end hinge 30 secured by a stationary pivot 32, and by a slidable hinge 31.

Figure 5:
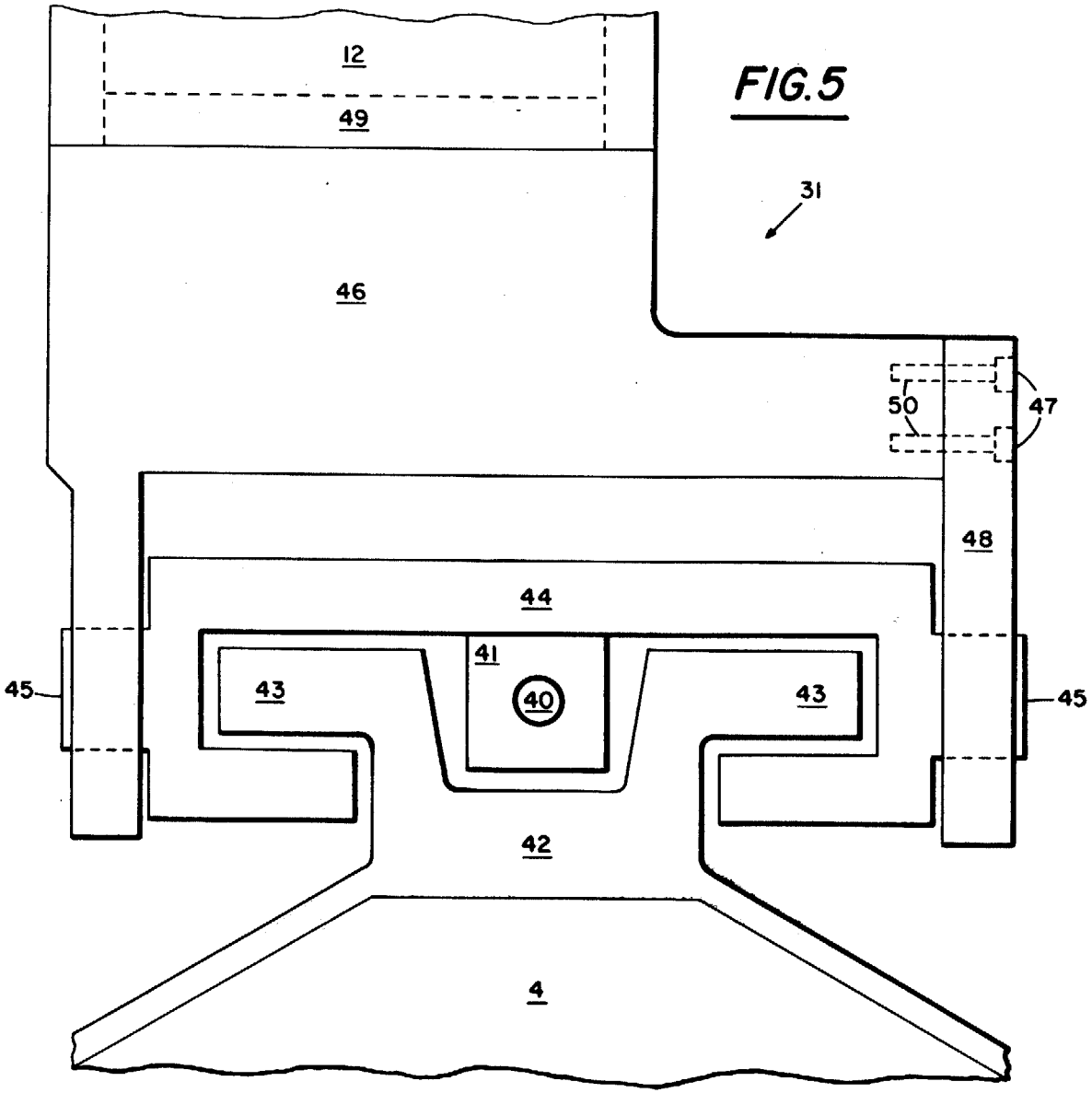
FIG. 5 is an enlarged section taken along plane I—I of FIG. 3.

Referring to FIG. 5, an enlarged sectional view taken along plane I—I of FIG. 3, the design and assembly of slidable hinge 31 is better illustrated. The surface of support body 4 comprises a plurality of extruded tracks 42, each track 42 serving a set of scissor arms 13. Extruded track 42 consists of two projections 43 separated by a notch in the form of a square U which extend longitudinally along the outer surface of support body 4. Each projection 43 is undercut along its side which faces away from the notch. Slidable hinge 31 comprises C-shaped slider 44 and the clevis formed from arms 46 and 48.

Slider 44 slidably engages extruded projections 43. Threaded nut 41, joined to slider 44, extends into the notch of extruded track 42, there engaging threaded lead screw 40. A trunnion 45 extends off of each end of slider 44.

The clevis comprising arms 46 and 48 spans slider 44 and attaches thereto by holes in arms 46 and 48 into which fit trunnions 45. Clevis arm 46 is made integral with fitting 49 which welds into an end of one innermost member 12. Clevis arm 48 is attached to clevis arm 46 by bolts 47 which thread onto threaded dowels 50.

Figure 6:
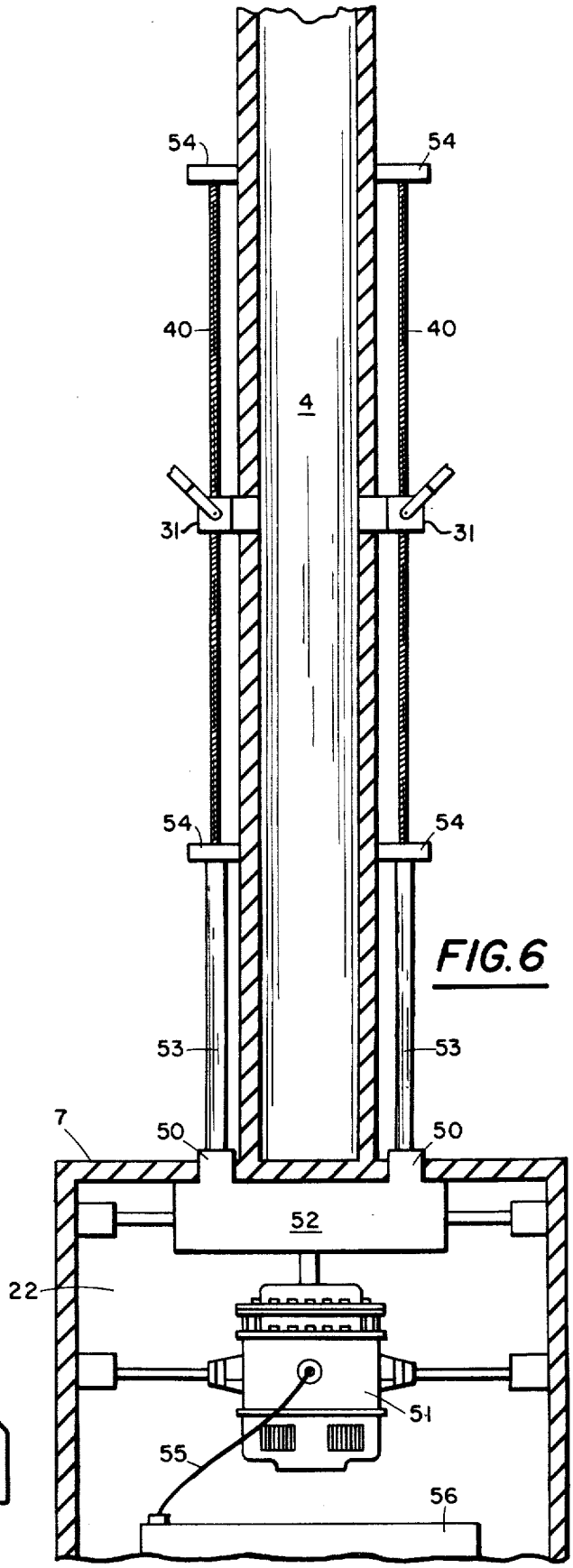
FIG. 6 is an enlarged partial schematic of the lower portion of the support means showing the drive and linkage mechanisms for extending and retracting the scissor arms.

The method for extending and retracting scissor arms 13 can be understood with reference to FIG. 6. The scissor arms driving means comprises reversible electric motor 51 connected to gear box 52 which provides one output shaft 53 for each scissor arm 13. Output shafts 53 penetrate the flattened top of tail section 7 through pressure-compensated seals 50 and extend upward to form an effective coaxial connection with lead screws 40. Lead screws 40, because of great slenderness ratio, have thrust bearings 54 at each end so that they operate in tension. Electric motor 51 is connected, via conventional electrical cable 55, to electrical power source 56. The scissor arm drive system including motor, power source, and gear box, can comprise any assembly of like components known in the underwater technology art. For example, power source 56 can comprise a compact, high energy density, seawater activated battery. Compact, reliable, and efficient DC motor and gear box assemblies, suitable for use in an oceanographic environment, have been developed for use in conjunction with a seawater battery.

After support body 4 has been lowered to a desired depth, electric motor 51 is activated, causing lead screws 40 to rotate. Rotating motion of lead screw 40 is translated into linear movement of slidable hinge 31 along the length of lead screw 40 by threaded nut 41. As slidable hinge 31 moves away from tail section 7 toward stationary pivot 32, scissor arm 13 is extended. When the direction of electric motor 51 is reversed, slidable hinge 31 moves toward tail section 7 thereby retracting scissor arm 13. The drive capacity required of electric motor 51 is minimized by the neutral buoyancy of scissor arm members 12. Scissor arms 13 are latched into retraction or extension by the physical resistance of electric motor 51 which may be a clutch-brake motor or equivalent.

As with watertight sections 20 and 28, standard techniques for seawater pressure compensation can be used to maintain the integrity of gearbox 52 through pressure seals 50. For example, the watertight housings of the sections and gearbox can be oil-filled and the apertures for cables 9 and 10 and output shafts 53 can be oil-sealed. An oil-filled bellows, connected between the exterior and interior of a housing, can transfer seawater pressure to the interior of the housing and therethrough to the seals. With pressure equalized on both sides, the integrity of a seal will be maintained.

In the preferred embodiment, while reeling mechanisms 19 and 23 are powered through spar buoy 8 from an auxiliary surface vessel, drive motor 51 is provided with onboard power source 56. The great depth at which the support structure will be deployed makes transmission of power to drive motor 51 inefficient. Moreover, the size of a power conduction path required from such a distance would tend to control the mass of cable 10. However, actuation of drive motor 10 is controlled by an auxiliary surface vessel over an electrical path extending through spar buoy 8, cable 9 and cable 10.

The foregoing description taken together with the appending claims constitutes a disclosure of a specific embodiment of the subject invention such as to enable one reasonably skilled in the electronics and marine engineering arts, and having the benefit of the teachings contained herein, to make and use the invention.

Obviously, many modifications and variations of the present invention are possible in light of the above teachings, and, it is therefore understood that, within the scope of the disclosed inventive concept, the invention may be practiced otherwise than as specifically described.

What is claimed is:

1. An instrumentation array support structure for use in a water medium, comprising:

a container means having a rounded nose and a bottom;

a separable tail portion fitted to said container means to close the bottom thereof;

an elongated support means joined to the top of said tail portion, said support means being slidable within said container means;

first reel and cable means connecting said support means with said container, whereby said support means can be moved into and out of said container on said cable means;

a plurality of scissor arms mounted on said support means by linkage means; and driving means contained within said tail portion and connected to said linkage means for extending and retracting said scissor arms.

2. An instrumentation array support structure according to claim 1 wherein said container means further comprises:

a float releasably housed within said nose of said container means; and second reel and cable means connecting said float to said container means;

whereby said container means can be reeled to and from said float on said second cable means.

3. An instrumentation array support structure according to claim 2 wherein said container means further comprises:

means for varying the buoyancy of the container means;

whereby said container means can be positioned in the water.

4. An instrumentation array support structure according to claim 1 wherein said tail section tapers to a finned ogive bottom whereby when said container means and said tail portion are joined, a hydrodynamically shaped body is formed.

5. A sensor array support structure according to claim 4 wherein said tail portion further comprises:

means for varying the buoyancy of the tail portion;

whereby said tail portion can be positioned in the water.

6. An instrumentation array support structure according to claim 1 wherein said linkage means includes:

means fixed to said support means for pivotally mounting one scissor arm member thereto; and means slidable along said support means for mounting another scissor arm member for pivotal movement therealong.

7. An instrumentation array support structure according to claim 1 wherein said driving means includes:

reversible motor means;

gear drive means connected to said motor means, said gear drive means having an output means for each of said scissor arms;

screw means connected to said output means and extending upwardly therefrom; and threaded means for engaging said screw means.

8. An instrumentation array support structure according to claim 7 wherein said container means further comprises:

a float releasably housed within said nose of said container means; and second reel and cable means connecting said float to said container means;

whereby said container means can be reeled to and from said float on said second cable means.

9. An instrumentation array support structure according to claim 8 wherein said container means further comprises:

means for varying the buoyancy of the container means;

whereby said container means can be positioned in the water.

10. An instrumentation array support structure according to claim 9 wherein said tail section tapers to a finned ogive bottom whereby when said container means and said tail portion are joined, a hydrodynamically shaped body is formed.

11. An instrumentation array support structure according to claim 10 wherein said tail portion further comprises:

means for varying the buoyancy of the tail portion;

whereby said tail portion can be positioned in the water.

12. An instrumentation array support structure according to claim 11 wherein said linkage means includes:

means fixed to said support means for pivotally mounting one scissor arm member thereto; and means mounted on said threaded means to be slidable along said support means for mounting another scissor arm member for pivotal movement therealong.

13. An instrumentation array support structure according to claim 12 further including:

a plurality of tension means connected to said scissor arms to maintain said scissor arms radial to said support means and evenly spaced.

14. A sensor array structure for use in a water medium, comprising:

a variably buoyant carrier means;

a plurality of scissor arms mounted on said carrier means by linkage means;

driving means for extending and retracting said scissor arms; and a plurality of sensor elements mounted upon said scissor arms in a spaced relationship.

15. The sensor array structure of claim 14 wherein said carrier means includes:

a variably buoyant, hydrodynamically shaped container having a top and a bottom;

an elongated support means having a top and a bottom, said support means being slidable within said container; and cable and reeling means connecting said support means with said container;

whereby said support means can be moved into and out of said container.

16. The sensor array structure of claim 15 wherein:

said scissor arms are mounted on said support means.

17. The sensor array structure of claim 16 wherein:

a variable buoyant bottom portion of said container is separable from the remainder of said container and is attached to the bottom of said support means.

18. The sensor array structure of claim 17 further including:

a float releasably housed within the top of sad container; and second cable and reeling means connecting said float with said cylinder;

whereby said cylinder can be reeled to and from said float.

19. The sensor array structure of claim 18 wherein said linkage means includes:

means fixed to the support means for pivotally mounting one scissor arm member thereto; and means slidable along the support means for mounting another scissor arm member for movement therealong.

20. The sensor array structure of claim 19 wherein said driving means includes:

reversible power means located within the bottom portion of said support means;

gear drive means effectively connected to said power means, said gear drive means having an output means for each of said scissor arms;

screw means effectively connected to said output means and extending upwardly therefrom;

threaded means for engaging said screw means, said threaded means effectively attached to said second pivot means.

* * * * *